US008572957B2

(12) United States Patent
Ikeda et al.

(10) Patent No.: US 8,572,957 B2
(45) Date of Patent: Nov. 5, 2013

(54) HYDRAULIC SYSTEM FOR CONSTRUCTION EQUIPMENT

(75) Inventors: Toshimichi Ikeda, Kyungsangnam-do (KR); Yang Koo Lee, Gyeongsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 1111 days.

(21) Appl. No.: 12/545,653

(22) Filed: Aug. 21, 2009

(65) Prior Publication Data

US 2010/0043420 A1 Feb. 25, 2010

(30) Foreign Application Priority Data

Aug. 21, 2008 (KR) ..... 10-2008-0082028
Oct. 13, 2008 (KR) ..... 10-2008-0100107

(51) Int. Cl.
*F15B 11/17* (2006.01)

(52) U.S. Cl.
USPC ..... 60/421; 60/429; 60/486

(58) Field of Classification Search
USPC ..... 60/421, 429, 486
See application file for complete search history.

(56) References Cited

U.S. PATENT DOCUMENTS 4,961,371 A * 10/1990 Takashima ..... 91/530
6,330,797 B1 * 12/2001 Kondo ..... 60/421
6,799,424 B2 * 10/2004 Ioku et al. ..... 60/486

* cited by examiner

*Primary Examiner* — F. Daniel Lopez
(74) *Attorney, Agent, or Firm* — Ladas & Parry LLP

(57) ABSTRACT

A hydraulic system for construction equipment is provided, which can increase the driving speed of a corresponding working device by making hydraulic fluid of a hydraulic pump, which is added to the hydraulic system having two hydraulic pumps in the construction equipment, join hydraulic fluid on the working device side, and can intercept the supply of hydraulic fluid from the working device side to a traveling apparatus side when the working device and the traveling apparatus are simultaneously manipulated.

4 Claims, 8 Drawing Sheets

HYDRAULIC SYSTEM FOR CONSTRUCTION EQUIPMENT

CROSS-REFERENCE TO RELATED APPLICATION

This application is based on and claims priority from Korean Patent Application Nos. 10-2008-0082028 and 10-2008-0100107, filed on Aug. 21, 2008 and Oct. 13, 2008, respectively in the Korean Intellectual Property Office, the disclosure of which is incorporated herein in its entirety by reference.

FIELD OF THE INVENTION

The present invention relates to a hydraulic system for construction equipment that can increase the driving speed of a working device through the addition of a separate hydraulic pump to the hydraulic system which has two hydraulic pumps and which is generally applied to the construction equipment such as an excavator.

More particularly, the present invention relates to a hydraulic system for construction equipment, which can increase the driving speed of a corresponding working device by making hydraulic fluid of a hydraulic pump, which is added to the hydraulic system using two hydraulic pumps, join hydraulic fluid on the working device side, and can intercept the supply of hydraulic fluid from the working device side to a traveling apparatus side when the working device and the traveling apparatus are simultaneously manipulated.

BACKGROUND OF THE INVENTION

A general excavator, as illustrated in FIG. 1, includes a lower driving structure 1; an upper swing structure 2 mounted on the lower driving structure 1 to be swiveled; a cap 3 and an engine room 4 mounted on the upper swing structure 2; a working device 11 including a boom 6 fixed to the upper swing structure 2 and driven by a boom cylinder 5, an arm 8 driven by an arm cylinder 7, and a bucket 10 driven by a bucket cylinder 9; and a counter weight 12 mounted on the upper swing structure 2.

A conventional hydraulic system for construction equipment, as illustrated in FIG. 2, includes first and second variable displacement hydraulic pumps 50 and 51 connected to an engine (not illustrated); a first traveling control valve 54 installed in a center bypass path 52 of a first hydraulic pump 50 to control the start, stop, and direction change of a left traveling motor 53; first control valves 58 and 59 installed in the center bypass path 52 on a downstream side of the first traveling control valve 54 and connected together through a parallel line 55 to control hydraulic fluid being supplied to a swing motor 56 and an arm cylinder 57; a second traveling control valve 62 installed in a center bypass path 60 of a second hydraulic pump 51 to control the start, stop, and direction change of a right traveling motor 61; and second control valves 66 and 67 installed in the center bypass path 60 on a downstream side of the second traveling control valve 62 and connected together through a parallel line 63 to control hydraulic fluid being supplied to working devices such as a boom cylinder 64 and a bucket cylinder 65.

If the first traveling control valve 54 is shifted during an independent traveling of an excavator, the left traveling motor 53 is driven by the hydraulic fluid being supplied from the first hydraulic pump 50, while if the second traveling control valve 62 is shifted, the right traveling motor 61 is driven by the hydraulic fluid being supplied from the second hydraulic pump 51. Accordingly, the excavator can travel smoothly.

When a combined work is performed through simultaneous driving of a traveling apparatus and a working device such as a boom, a part of the hydraulic fluid discharged from the first hydraulic pump 50 is supplied to the left traveling motor 53 through the first traveling control valve 54, and simultaneously, another part of the hydraulic fluid from the first hydraulic pump 50 is supplied to the boom cylinder 64 via a control valve 68 provided on the parallel line 55.

In addition, a part of the hydraulic fluid discharged from the second hydraulic pump 51 is supplied to the right traveling motor through the second traveling control valve 62, and simultaneously, another part of the hydraulic fluid from the second hydraulic pump 51 is supplied to the boom cylinder 64 via the second control valve 66 provided on the parallel line 63.

That is, in the excavator to which a hydraulic system using two hydraulic pumps having the same capacity is applied, the left traveling motor 53 and the working device (e.g. the arm cylinder 56 and so on) are driven by the hydraulic fluid discharged from the first hydraulic pump 50, and the right traveling motor 61 and the working device (e.g. the boom cylinder 64 and so on) are driven by the hydraulic fluid discharged from the second hydraulic pump 51, so that the excavator can travel straight during the combined work for simultaneously driving the traveling apparatus and the working device.

On the other hand, in the case of performing a work that produces a great load according to work conditions, a large-scale excavator may be used. In this case, hydraulic pumps, control valves, and actuators of desired capacities are mounted on the excavator. However, if a large-capacity hydraulic pump cannot be used in the excavator (due to its expensiveness and so on), a third hydraulic pump may be additionally installed in the excavator instead.

Another conventional hydraulic system for construction equipment, as illustrated in FIG. 3, includes first and second variable displacement hydraulic pumps 50 and 51 connected to an engine (not illustrated) and so on; a first traveling control valve 54 installed in a center bypass path 52 of a first hydraulic pump 50 to control the start, stop, and direction change of a left traveling motor 53; first control valves 58 and 59 installed in the center bypass path 52 on a downstream side of the first traveling control valve 54 and connected together through a parallel line 55 to control hydraulic fluid being supplied to a swing motor 56 and an arm cylinder 57; a second traveling control valve 62 installed in a center bypass path 60 of a second hydraulic pump 51 to control the start, stop, and direction change of a right traveling motor 61; second control valves 66 and 67 installed in the center bypass path 60 on a downstream side of the second traveling control valve 62 and connected together through a parallel line 63 to control hydraulic fluid being supplied to working devices such as a boom cylinder 64 and a bucket cylinder 65; and a third variable displacement hydraulic pump 69 connected to the center bypass path 60 on an upstream side of the second hydraulic pump 51 and the parallel line 63 to increase the supply amount of hydraulic fluid to the working device so that the driving speed of the working device is increased.

In this case, the construction except for the third hydraulic pump 69 for additionally supplying the hydraulic fluid so as to increase the speed of the corresponding actuator of the working device is substantially the same as the construction of the hydraulic system as illustrated in FIG. 2, and thus the detailed description thereof will be omitted. Also, the same drawing reference numerals are used for the same elements across various figures.

In the case of increasing the driving speed of the corresponding working device (e.g. the boom cylinder 64) on the second hydraulic pump side 51 by the hydraulic fluid being supplied from the third hydraulic pump 69, a part of the hydraulic pump discharged from the third hydraulic pump 69 is also supplied to the traveling motor. Accordingly, the supply amount of hydraulic fluid becomes unbalanced due to the difference in load pressure occurring between the working device side and the traveling apparatus side, and thus the straight traveling of the construction equipment cannot be secured.

SUMMARY OF THE INVENTION

Accordingly, the present invention has been made to solve the above-mentioned problems occurring in the prior art while advantages achieved by the prior art are maintained intact.

Embodiments of the present invention relate to a hydraulic system for construction equipment, which can increase the driving speed of a corresponding working device and thus can improve the workability of the construction equipment by making hydraulic fluid of a hydraulic pump added to the hydraulic system join hydraulic fluid on the working device side when the working device of the construction equipment, to which the hydraulic system using two hydraulic pumps is applied, is driven.

Embodiments of the present invention relate to a hydraulic system for construction equipment, which can secure the straight traveling of the construction equipment by intercepting the supply of hydraulic fluid from a working device side to a traveling apparatus side when the working device and the traveling apparatus are simultaneously manipulated.

Embodiments of the present invention relate to a hydraulic system for construction equipment, which can minimize a loss of pressure generated when hydraulic fluid from an added hydraulic pump joins hydraulic fluid on a working device side.

In one aspect of the present invention, there is provided a hydraulic system for construction equipment, which includes first and second variable displacement hydraulic pumps connected to an engine; a first traveling control valve installed in a center bypass path of a first hydraulic pump to control the start, stop, and direction change of a left traveling motor; first control valves installed in the center bypass path on a downstream side of the first traveling control valve and connected together through a parallel line to control hydraulic fluid being supplied to a swing motor and an arm cylinder; a second traveling control valve installed in a center bypass path of a second hydraulic pump to control the start, stop, and direction change of a right traveling motor; second control valves installed in the center bypass path on a downstream side of the second traveling control valve and connected together through a parallel line to control hydraulic fluid being supplied to a boom cylinder and a bucket cylinder; and a third variable displacement hydraulic pump connected to the center bypass path of the second hydraulic pump through a branch flow path branched from a discharge flow path that is connected between the downstream side of any one of the first and second traveling control valves and the corresponding parallel line; wherein if a corresponding actuator is driven through manipulation of at least one of the first and second control valves, hydraulic fluid being supplied from the third hydraulic pump joins hydraulic fluid of the actuator, to which the hydraulic fluid from the first and second hydraulic pumps is supplied so as to increase the driving speed of the actuator.

The hydraulic system for construction equipment according to an embodiment of the present invention may further include a backward flow prevention check valve installed in the discharge flow path of the third hydraulic pump connected to the parallel line on the second hydraulic pump side.

The hydraulic system for construction equipment according to an embodiment of the present invention may further include a backward flow prevention check valve installed on an upstream side of the parallel line on the second hydraulic pump side to intercept the supply of hydraulic fluid from a working device side to a traveling apparatus side when the working device and the traveling apparatus are simultaneously driven.

In another aspect of the present invention, there is provided a hydraulic system for construction equipment, which includes first and second variable displacement hydraulic pumps connected to an engine; a first traveling control valve installed in a center bypass path of a first hydraulic pump to control the start, stop, and direction change of a left traveling motor; first control valves installed in the center bypass path on a downstream side of the first traveling control valve and connected together through a parallel line to control hydraulic fluid being supplied to a swing motor and an arm cylinder; a second traveling control valve installed in a center bypass path of a second hydraulic pump to control the start, stop, and direction change of a right traveling motor; second control valves installed in the center bypass path on a downstream side of the second traveling control valve and connected together through a parallel line to control hydraulic fluid being supplied to a boom cylinder and a bucket cylinder; and a third variable displacement hydraulic pump connected to the center bypass path through a branch flow path branched from a discharge flow path that is connected between an input port of the first control valve, which is installed on the lowermost downstream side of the center bypass path of any one of the first and second hydraulic pumps, and the parallel line; wherein hydraulic fluid discharged from the third hydraulic pump joins hydraulic fluid of the arm cylinder that is driven by the first control valve installed on the lowermost downstream side of the center bypass path of the first hydraulic pump, to increase the driving speed of the arm cylinder.

The hydraulic system for construction equipment according to another embodiment of the present invention may further include a backward flow prevention check valve installed in the discharge flow path of the third hydraulic pump connected to the parallel line on the first hydraulic pump side.

The hydraulic system for construction equipment according to an embodiment of the present invention may further include a backward flow prevention check valve installed on an upstream side of the parallel line on the first hydraulic pump side to intercept the supply of hydraulic fluid from a working device side to a traveling apparatus side when the working device and the traveling apparatus are simultaneously driven.

In still another aspect of the present invention, there is provided a hydraulic system for construction equipment, which includes first, second, and third variable displacement hydraulic pumps connected to an engine; a first traveling control valve installed in a center bypass path of a first hydraulic pump to control the start, stop, and direction change of a left traveling motor; first control valves installed in the center bypass path on a downstream side of the first traveling control valve and connected together through a parallel line to control hydraulic fluid being supplied to a boom cylinder, a swing motor, and an arm cylinder; a second traveling control valve installed in a center bypass path of a second hydraulic pump to control the start, stop, and direction change of a right traveling motor; second control valves installed in the center bypass path on a downstream side of the second traveling control valve and connected together through a parallel line to control hydraulic fluid being supplied to the boom cylinder, a bucket cylinder, and the arm cylinder; a first path connected to a discharge flow path of a third hydraulic pump and connected to the center bypass paths of the first and second hydraulic pumps on the downstream sides of the first and second traveling control valves through first and second check valves, respectively; and a second path connected to the discharge flow path of the third hydraulic pump and connected to the parallel lines of the first and second hydraulic pumps on the downstream sides of the first and second traveling control valves through third and fourth check valves, respectively.

In still another aspect of the present invention, there is provided a hydraulic system for construction equipment, which includes first, second, and third variable displacement hydraulic pumps connected to an engine; a first traveling control valve installed in a center bypass path of a first hydraulic pump to control the start, stop, and direction change of a left traveling motor; first control valves installed in the center bypass path on a downstream side of the first traveling control valve and connected together through a parallel line to control hydraulic fluid being supplied to a boom cylinder, a swing motor, and an arm cylinder; a second traveling control valve installed in a center bypass path of a second hydraulic pump to control the start, stop, and direction change of a right traveling motor; second control valves installed in the center bypass path on a downstream side of the second traveling control valve and connected together through a parallel line to control hydraulic fluid being supplied to the boom cylinder, a bucket cylinder, and the arm cylinder; a first path connected to a discharge flow path of a third hydraulic pump and connected to input ports of the first and second control valves on the lowermost downstream sides, among the whole first and second control valves, through first and second check valves, respectively; and a second path connected to the discharge flow path of the third hydraulic pump and connected to the lowermost downstream sides of the parallel lines of the first and second hydraulic pumps through third and fourth check valves, respectively.

In still another aspect of the present invention, there is provided a hydraulic system for construction equipment, which includes first, second, and third variable displacement hydraulic pumps connected to an engine; a first traveling control valve installed in a center bypass path of a first hydraulic pump to control the start, stop, and direction change of a left traveling motor; first control valves installed in the center bypass path on a downstream side of the first traveling control valve and connected together through a parallel line to control hydraulic fluid being supplied to a boom cylinder, a swing motor, and an arm cylinder; a second traveling control valve installed in a center bypass path of a second hydraulic pump to control the start, stop, and direction change of a right traveling motor; second control valves installed in the center bypass path on a downstream side of the second traveling control valve and connected together through a parallel line to control hydraulic fluid being supplied to the boom cylinder, a bucket cylinder, and the arm cylinder; a second path connected to a discharge flow path of a third hydraulic pump and connected to the parallel lines of the first and second hydraulic pumps on the downstream sides of the first and second traveling control valves through third and fourth check valves, respectively; and an unload valve installed in the discharge flow path of the third hydraulic pump and shifted to supply hydraulic fluid from the third hydraulic pump to the parallel lines of the first and second hydraulic pumps, respectively when a working device is manipulated.

The hydraulic system for construction equipment according to embodiments of the present invention may further include a backward flow prevention check valve installed on an upstream side of the parallel line of the first hydraulic pump to intercept the supply of hydraulic fluid from a working device side to a traveling apparatus side when the working device on the first hydraulic pump side and the traveling apparatus are simultaneously driven; and a backward flow prevention check valve installed on an upstream side of the parallel line of the second hydraulic pump to intercept the supply of hydraulic fluid from a working device side to a traveling apparatus side when the working device on the second hydraulic pump side and the traveling apparatus are simultaneously driven.

With the above-described construction, the hydraulic system for construction equipment according to embodiments of the present invention has the following advantages.

Since the hydraulic fluid of a hydraulic pump, which is added to a hydraulic system of an excavator and so on using two hydraulic pumps, joins the hydraulic fluid on the working device side, the driving speed of the corresponding working device is increased, and the straight traveling of the construction equipment is secured when the working device and the traveling apparatus are simultaneously manipulated.

A loss of pressure generated when the hydraulic fluid from an added hydraulic pump joins the hydraulic fluid on the working device side is minimized, and thus fuel consumption due to such an energy loss is reduced.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 4:
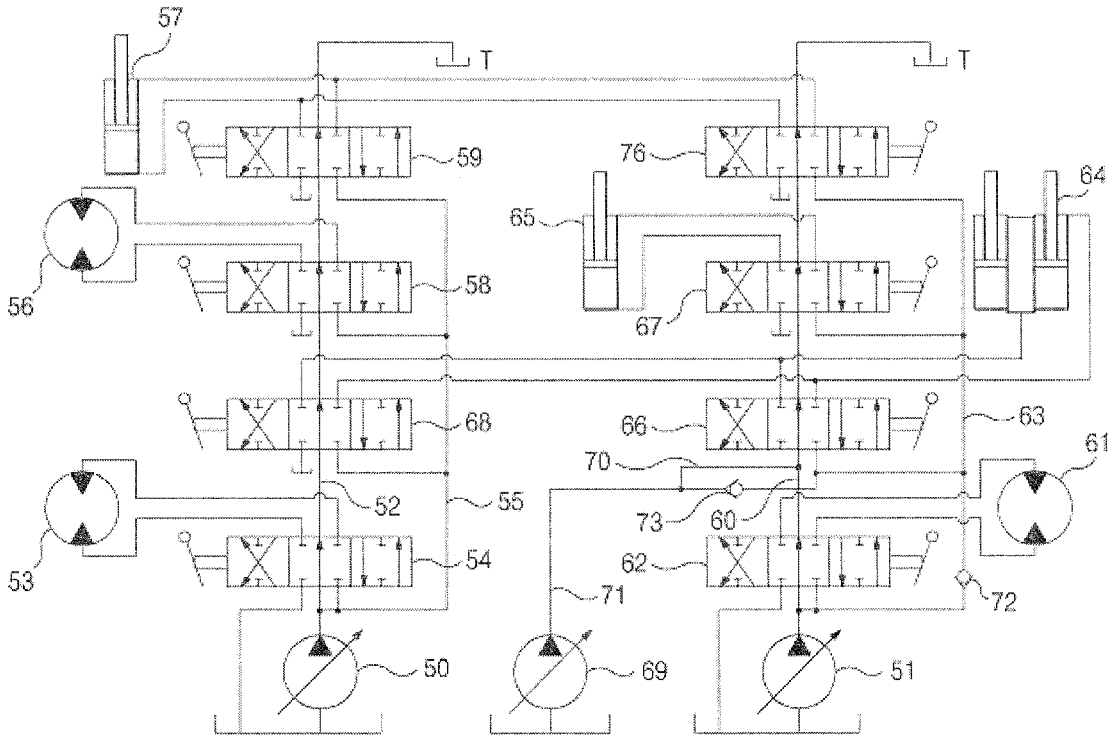
FIG. 4 is a view schematically illustrating a hydraulic system for construction equipment according to an embodiment of the present invention.

As illustrated in FIG. 4, a hydraulic system for construction equipment according to an embodiment of the present invention includes first and second variable displacement hydraulic pumps 50 and 51; a first traveling control valve 54 installed in a center bypass path 52 of a first hydraulic pump 50 to control the start, stop, and direction change of a left traveling motor 53; first control valves 58 and 59 installed in the center bypass path 52 on a downstream side of the first traveling control valve 54 and connected together through a parallel line 55 to control hydraulic fluid being supplied to a swing motor 56 and an arm cylinder 57; a second traveling control valve 62 installed in a center bypass path 60 of a second hydraulic pump 51 to control the start, stop, and direction change of a right traveling motor 61; second control valves 66 and 67 installed in the center bypass path 60 on a downstream side of the second traveling control valve 62 and connected together through a parallel line 63 to control hydraulic fluid being supplied to working devices such as a boom cylinder 64 and a bucket cylinder 65; and a third variable displacement hydraulic pump 69 connected to the center bypass path 60 through a branch flow path 70 branched from a discharge flow path 71 that is connected between the downstream side of any one of the first and second traveling control valves 54 and 62 and the corresponding parallel line 63; wherein if a corresponding actuator (e.g. the boom cylinder 64 and so on) is driven through manipulation of at least one of the first and second control valves 58 and 59, and 66 and 67, hydraulic fluid being supplied from the third hydraulic pump 69 joins hydraulic fluid of the actuator, to which the hydraulic fluid from the first and second hydraulic pumps 50 and 51 is supplied, so as to increase the driving speed of the actuator.

The hydraulic system for construction equipment according to an embodiment of the present invention further includes a backward flow prevention check valve 73 installed in the discharge flow path 71 of the third hydraulic pump 69 connected to the parallel line 63 on the second hydraulic pump side.

The hydraulic system for construction equipment according to an embodiment of the present invention further includes a backward flow prevention check valve 72 installed on an upstream side of the parallel line 63 on the second hydraulic pump side to intercept the supply of hydraulic fluid from a working device side to a traveling apparatus side when the working device and the traveling apparatus are simultaneously driven.

Hereinafter, the operation of the hydraulic system for construction equipment according to an embodiment of the present invention will be described with reference to the accompanying drawings.

In the case where the boom cylinder 64 is independently manipulated as illustrated in FIG. 4, the hydraulic fluid discharged from the third hydraulic pump 69 joins the hydraulic fluid of the center bypass path 60, having passed through the second traveling control valve 62 by the branch flow path 70 branched from the discharge flow path 71, and then is supplied to the input port of the second control valve 66 via the check valve 73 installed in the discharge flow path 71.

Accordingly, the second control valve 66 is shifted to close the center bypass path 60, and the hydraulic fluid discharged from the second hydraulic pump 51 flows into the input port of the second control valve 66 through the parallel line 63. In this case, the hydraulic fluid from the third hydraulic pump 69 joins the hydraulic fluid being supplied from the second hydraulic pump 51 (at this time, the branch flow path 70 is in a closed state due to the shifting of the second control valve 66). Also, by the shifting of the control valve 68, the hydraulic fluid being supplied from the first hydraulic pump 50 joins the hydraulic fluid of the output port of the second control valve.

Accordingly, the boom cylinder 64 is driven by the hydraulic fluid being supplied from the first, second, and third hydraulic pumps 50, 51, and 69, and thus the driving speed of the boom cylinder is increased.

On the other hand, since the second control valve 67 for controlling the driving of the bucket cylinder 65 and the control valve 76 for controlling the driving of the arm cylinder 57 are installed on the downstream side of the second control valve 66 to constitute a parallel circuit through the parallel line 63, the same function as the boom cylinder 64 can be performed when the bucket cylinder 65 and the arm cylinder 57 are driven.

Also, since the bucket cylinder 65 and the arm cylinder 57 are connected together through the parallel line 63, the hydraulic fluid discharged from the third hydraulic fluid 69 can be supplemented even in the case where the bucket cylinder and the arm cylinder are simultaneously driven.

On the other hand, in the case of performing a combined work by driving the traveling apparatus during the manipulation of the boom cylinder 64, the hydraulic fluid being supplied to the boom cylinder 64 is prevented from being supplied to the second traveling control valve 62 by the check valve 72 installed on the upstream side of the parallel line 63 on the second hydraulic pump side.

Figure 5:
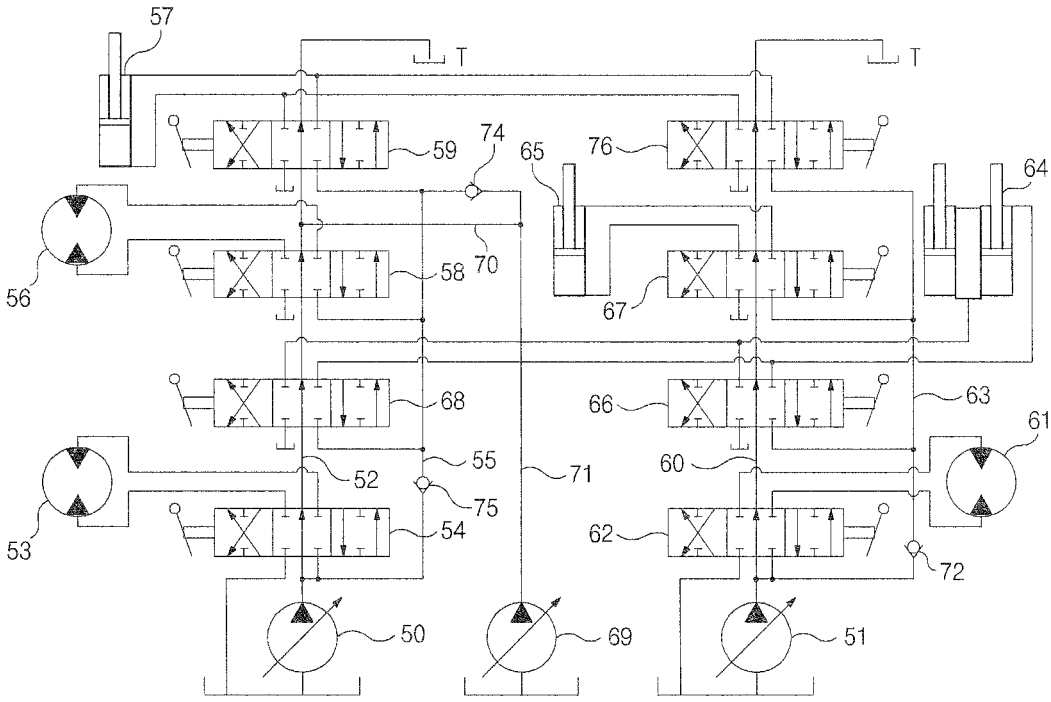
FIG. 5 is a view schematically illustrating a hydraulic system for construction equipment according to another embodiment of the present invention.

Accordingly, even in the case of simultaneously manipulating the working device and the traveling apparatus, the hydraulic fluid being supplied to the working device does not affect the traveling speed of the traveling apparatus, and thus the traveling apparatus can travel straight As illustrated in FIG. 5, a hydraulic system for construction equipment according to another embodiment of the present invention includes first and second variable displacement hydraulic pumps 50 and 51; a first traveling control valve 54 installed in a center bypass path 52 of a first hydraulic pump 50 to control the start, stop, and direction change of a left traveling motor 53; first control valves 58 and 59 installed in the center bypass path 52 on a downstream side of the first traveling control valve 54 and connected together through a parallel line 55 to control hydraulic fluid being supplied to a swing motor 56 and an arm cylinder 57; a second traveling control valve 62 installed in a center bypass path 60 of a second hydraulic pump 51 to control the start, stop, and direction change of a right traveling motor 61; second control valves 66 and 67 installed in the center bypass path 60 on a downstream side of the second traveling control valve 62 and connected together through a parallel line 63 to control hydraulic fluid being supplied to working devices such as a boom cylinder 64 and a bucket cylinder 65; and a third variable displacement hydraulic pump 69 connected to the center bypass path 52 through a branch flow path 70 branched from a discharge flow path 71 that is connected between an input port of the first control valve 59, which is installed on the lowermost downstream side of the center bypass path 52 of any one of the first and second hydraulic pumps 50 and 51, and the parallel line 55; wherein hydraulic fluid discharged from the third hydraulic pump 69 joins hydraulic fluid of the arm cylinder 57 that is driven by the first control valve 59 installed on the lowermost downstream side of the center bypass path 52, to increase the driving speed of the arm cylinder 57.

The hydraulic system for construction equipment according to another embodiment of the present invention further includes a backward flow prevention check valve 74 installed in the discharge flow path 71 of the third hydraulic pump 69 connected to the parallel line 55 on the first hydraulic pump side.

The hydraulic system for construction equipment according to another embodiment of the present invention further includes a backward flow prevention check valve 75 installed on an upstream side of the parallel line 55 on the first hydraulic pump side to intercept the supply of hydraulic fluid from a working device side to a traveling apparatus side when the working device and the traveling apparatus are simultaneously driven.

Figure 1:
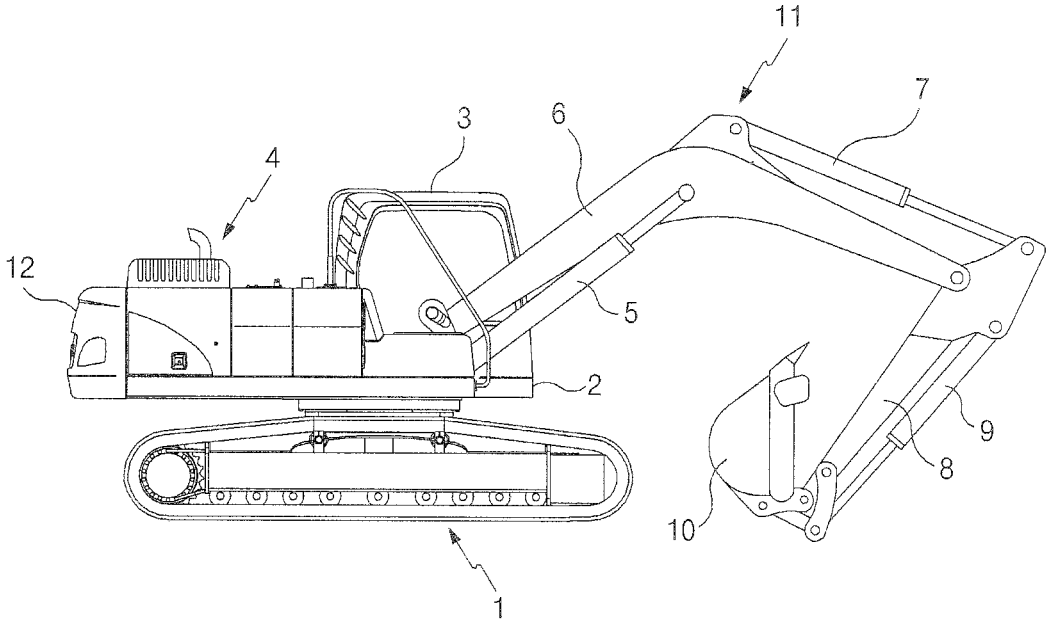
FIG. 1 is a view schematically illustrating a general excavator.
Figure 2:
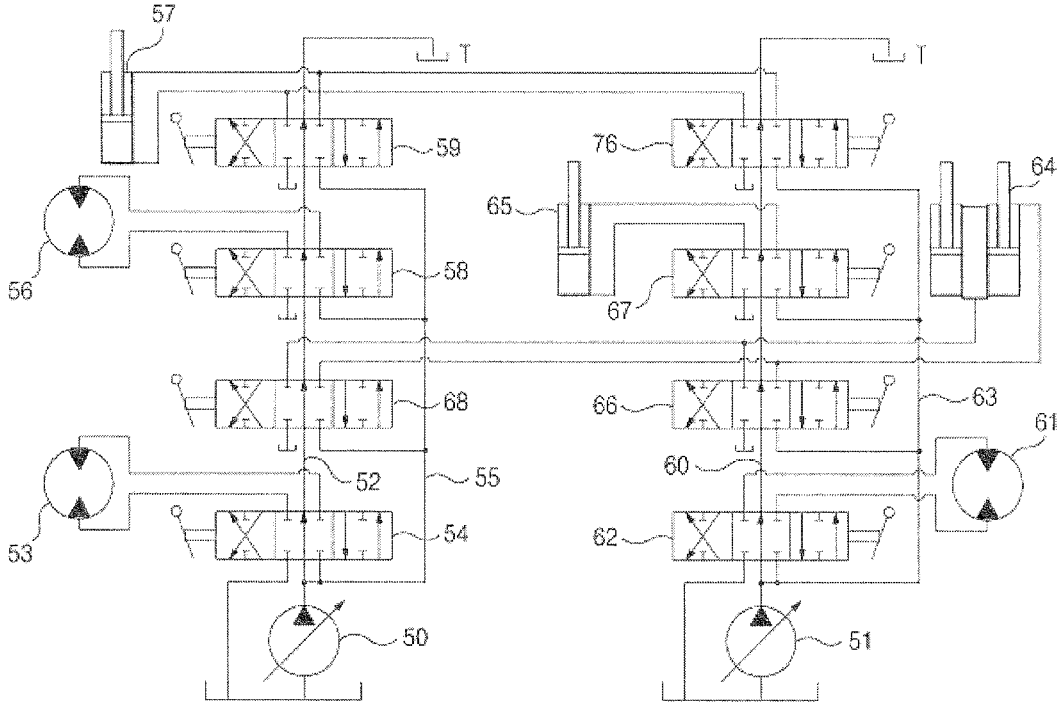
Fig. 2 Prior Art
FIG. 2 is a view schematically illustrating a conventional hydraulic system for construction equipment.
Figure 3:
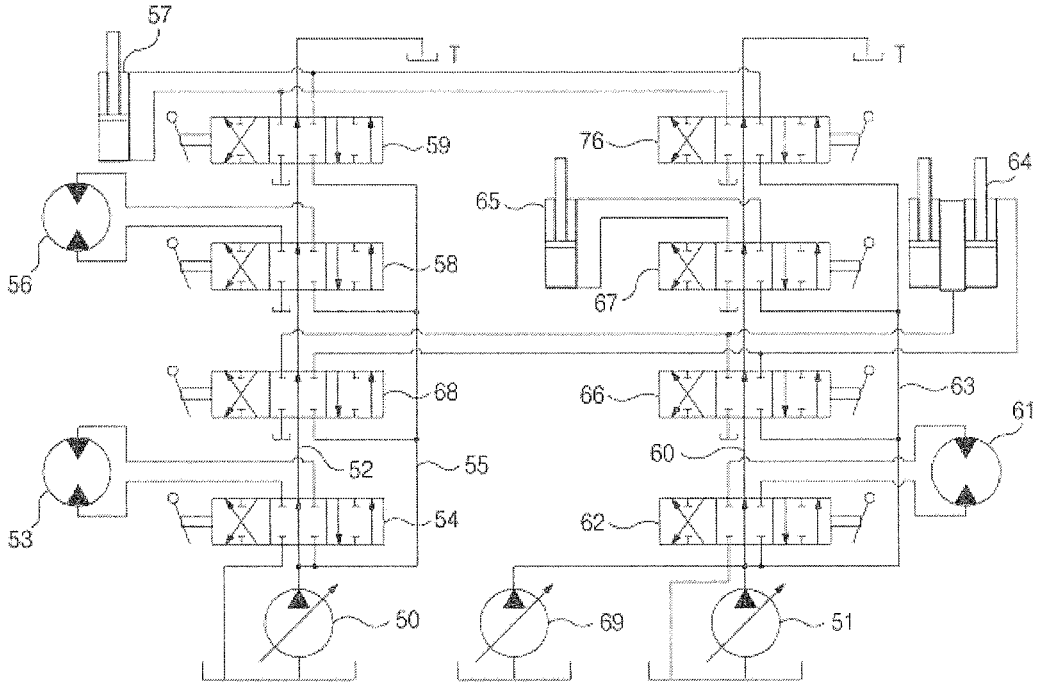
Fig. 3 Prior Art
FIG. 3 is an exemplary view illustrating a modified conventional hydraulic system for construction equipment.

Since the construction, except for the third hydraulic pump 69 for increasing the driving speed of the arm cylinder 57 by additionally supplying the hydraulic fluid to the arm cylinder 57 that is driven when the first control valve 59, which is installed on the lowermost downstream side of the center bypass path 52 of the first hydraulic pump 50, is shifted, and the backward flow prevention check valves 74 and 75, is substantially the same as the construction of the hydraulic system as illustrated in FIG. 3, the detailed description thereof will be omitted. Also, the same drawing reference numerals are used for the same elements across various figures.

In the hydraulic system for construction equipment according to another embodiment of the present invention, the hydraulic fluid discharged from the third hydraulic pump 69 is supplied to the center bypass path 52 of the first hydraulic pump 50 through the branch flow path 70 branched from the discharge flow path 71, and is simultaneously supplied to the input port of the first control valve 59 via the check valve 74.

Accordingly, when the first control valve 59 is shifted, the center bypass path 52 is closed, and thus the hydraulic fluid of the first hydraulic pump 50 flows into the input port of the first control valve 59 after it joins the hydraulic fluid of the third hydraulic pump 69 through the branch flow path 70.

In this case, the hydraulic fluid of the output port of the first control valve 59 joins the hydraulic fluid being supplied from the second hydraulic pump 51 in accordance with the shifting of the control valve 76, and then is supplied to the arm cylinder 57.

Accordingly, the arm cylinder 57 is driven by the hydraulic fluid being supplied from the first, second, and third hydraulic pumps 50, 51, and 69, and thus the driving speed of the arm cylinder can be increased.

Figure 6:
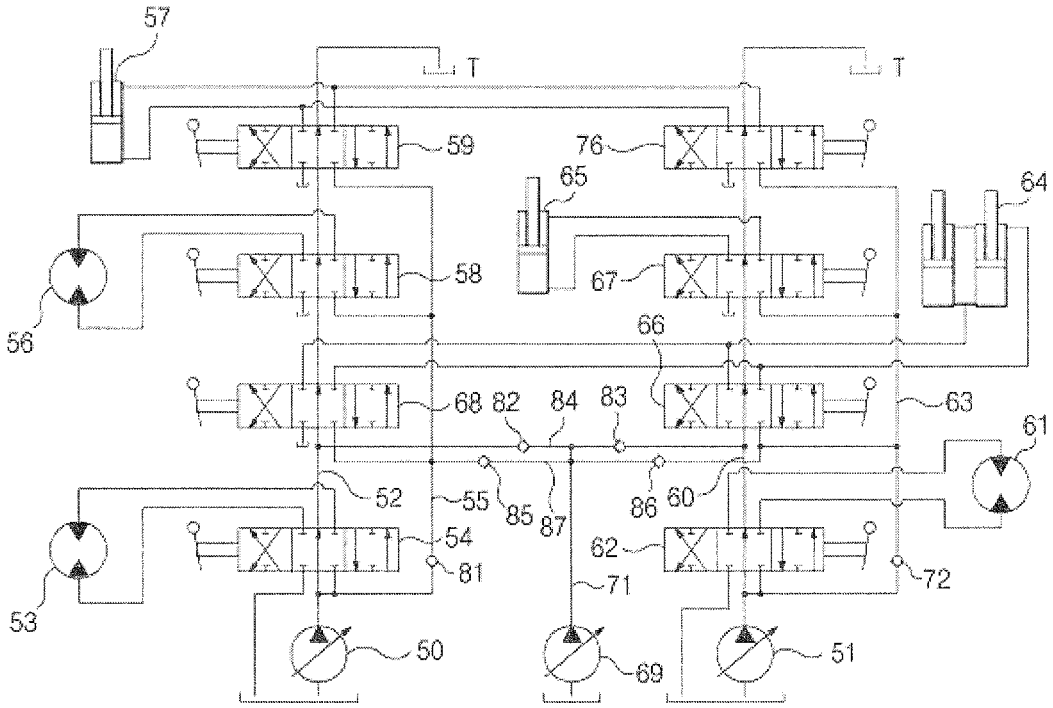
FIG. 6 is a view schematically illustrating a hydraulic system for construction equipment according to still another embodiment of the present invention.

As illustrated in FIG. 6, a hydraulic system for construction equipment according to still another embodiment of the present invention includes first, second, and third variable displacement hydraulic pumps 50, 51, and 69 connected to an engine; a first traveling control valve 54 installed in a center bypass path 52 of a first hydraulic pump 50 to control the start, stop, and direction change of a left traveling motor 53; first control valves 68, 58, and 59 installed in the center bypass path 52 on a downstream side of the first traveling control valve 54 and connected together through a parallel line 55 to control hydraulic fluid being supplied to a boom cylinder 64, a swing motor 56, and an arm cylinder 57; a second traveling control valve 62 installed in a center bypass path 60 of a second hydraulic pump 51 to control the start, stop, and direction change of a right traveling motor 61; second control valves 66, 67, and 76 installed in the center bypass path 60 on a downstream side of the second traveling control valve 62 and connected together through a parallel line 63 to control hydraulic fluid being supplied to working devices such as the boom cylinder 64, a bucket cylinder 65, and the arm cylinder 57; a first path 84 connected to a discharge flow path 71 of a third hydraulic pump 69 and connected to the center bypass paths 52 and 60 of the first and second hydraulic pumps 50 and 51 on the downstream sides of the first and second traveling control valves 54 and 62 through first and second check valves 82 and 83, respectively; and a second path 87 connected to the discharge flow path 71 of the third hydraulic pump 69 and connected to the parallel lines 55 and 63 of the first and second hydraulic pumps 50 and 51 on the downstream sides of the first and second traveling control valves 54 and 62 through third and fourth check valves 85 and 86, respectively.

The hydraulic system for construction equipment according to still another embodiment of the present invention further includes a backward flow prevention check valve 81 installed on an upstream side of the parallel line 55 of the first hydraulic pump 50 to intercept the supply of hydraulic fluid from a working device side to a traveling apparatus side when the working device on the first hydraulic pump side and the traveling apparatus are simultaneously driven; and a backward flow prevention check valve 72 installed on an upstream side of the parallel line 63 of the second hydraulic pump 51 to intercept the supply of hydraulic fluid from a working device side to a traveling apparatus side when the working device on the second hydraulic pump side and the traveling apparatus are simultaneously driven.

Since the construction, except for the first path 84 and the second path 87 connected to the discharge flow path 71 of the third hydraulic pump 69 to make the hydraulic fluid from the third hydraulic pump 69 to the hydraulic fluid of the working device of the first hydraulic pump 50 or the hydraulic fluid of the working device of the second hydraulic pump 51, and the backward flow prevention check valves 72 and 81, is substantially the same as the construction of the hydraulic system as illustrated in FIG. 3, the detailed description thereof will be omitted. Also, the same drawing reference numerals are used for the same elements across various figures.

Hereinafter, the operation of the hydraulic system for construction equipment according to still another embodiment of the present invention will be described with reference to the accompanying drawings.

In the case where the boom cylinder 64 is independently manipulated to drive the boom, as illustrated in FIG. 6, the second control valve 66 is shifted to close the center bypass path 60 on the second hydraulic pump side, and the hydraulic fluid discharged from the second hydraulic pump 51 is supplied to the boom cylinder 64 through the parallel line 63 and the second control valve 66. That is, the boom cylinder 64 is driven by the hydraulic fluid from the second hydraulic pump 51.

At this time, since the hydraulic fluid from the third hydraulic pump 69 is returned to a hydraulic tank through the center bypass path 52 on the first hydraulic pump side, it cannot join the hydraulic fluid being supplied to the boom cylinder 64.

On the other hand, in the case of shifting the second control valve 66 and the first control valve 68 to increase the boom driving speed, the center bypass path 52 on the first hydraulic pump side and the center bypass path 60 on the second hydraulic pump side are closed.

In this case, the hydraulic fluid from the third hydraulic pump 69 joins the hydraulic fluid being supplied from the first hydraulic pump 50 through the parallel line 55 and the first control valve 68 and the hydraulic fluid being supplied from the second hydraulic pump 51 through the parallel line 63 and the second control valve 66, and the joined hydraulic fluid is supplied to the boom cylinder 64.

Accordingly, the boom cylinder 64 is driven by the hydraulic fluid being supplied from the first, second, and third hydraulic pumps 50, 51, and 69, and thus the driving speed of the boom cylinder is increased.

Since the first and second control valves 59 and 76 for controlling the driving of the arm cylinder 57 are installed on the downstream side of the first and second control valves 68 and 66 and are connected together through the parallel lines 55 and 63, the hydraulic fluid from the third hydraulic fluid 69 can be supplemented in the same manner as the driving of the boom cylinder 64 when the arm cylinder 57 is driven.

In the case of driving the swing motor 56 by manipulating the first control valve 58, the hydraulic fluid from the third hydraulic pump 69 has a hydraulic pressure relatively lower than that of the center bypass path 60 on the second hydraulic pump side (in an unloaded state) Accordingly, the hydraulic fluid of the third hydraulic pump 69 cannot join the hydraulic fluid for driving the swing motor 56, and thus the swing motor 56 is driven by the hydraulic fluid being supplied from the first hydraulic pump 50.

That is, since the swing motor 56 does not require further supplement of hydraulic fluid from the third hydraulic pump 69 when it is driven, it can be smoothly driven by the hydraulic fluid being supplied from the first hydraulic pump 50.

On the other hand, in the case of performing a combined work by driving the traveling apparatus during the driving of the boom cylinder 64, the hydraulic fluid being supplied to the boom cylinder side is prevented from being supplied to the first and second traveling control valves 54 and 62 by the backward flow prevention check valve 81 installed on the upstream side of the parallel line 55 on the first hydraulic pump side and the backward flow prevention check valve 72 installed on the upstream side of the parallel line 63 on the second hydraulic pump side.

Accordingly, even in the case of making the hydraulic fluid from the third hydraulic pump 69 join the hydraulic fluid on the working device side, it does not affect the straight traveling of the equipment.

As described above, by making the same amount of hydraulic fluid from the third hydraulic pump 69 join the hydraulic fluid on the first and second hydraulic pump sides through the discharge flow path 71 and the first and second paths 84 and 87, respectively, a loss of pressure does not occur greatly in any one of the control valve of the first hydraulic pump 50 and the control valve of the second hydraulic pump 51, but can be equalized and minimized.

Figure 7:
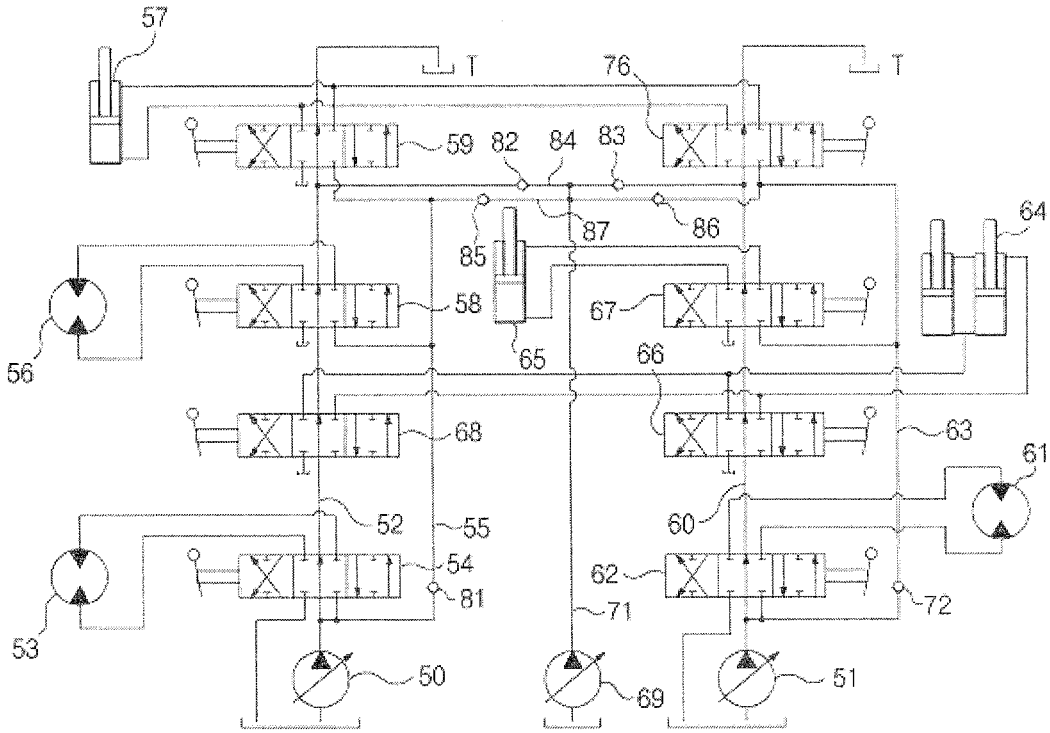
FIG. 7 is a view schematically illustrating a hydraulic system for construction equipment according to still another embodiment of the present invention.

As illustrated in FIG. 7, a hydraulic system for construction equipment according to still another embodiment of the present invention includes first, second, and third variable displacement hydraulic pumps 50, 51, and 69 connected to an engine; a first traveling control valve 54 installed in a center bypass path 52 of a first hydraulic pump 50 to control the start, stop, and direction change of a left traveling motor 53; first control valves 68, 58, and 59 installed in the center bypass path 52 on a downstream side of the first traveling control valve 54 and connected together through a parallel line 55 to control hydraulic fluid being supplied to a boom cylinder 64, a swing motor 56, and an arm cylinder 57; a second traveling control valve 62 installed in a center bypass path 60 of a second hydraulic pump 51 to control the start, stop, and direction change of a right traveling motor 61; second control valves 66, 67, and 76 installed in the center bypass path 60 on a downstream side of the second traveling control valve 62 and connected together through a parallel line 63 to control hydraulic fluid being supplied to working devices such as the boom cylinder 64, a bucket cylinder 65, and the arm cylinder 57; a first path 84 connected to a discharge flow path 71 of a third hydraulic pump 69 and connected to input ports of the first and second control valves 59 and 76 on the lowermost downstream sides, among the whole first and second control valves 68, 58 and 59, and 66, 67 and 76, through first and second check valves 82 and 83, respectively; and a second path 87 connected to the discharge flow path 71 of the third hydraulic pump 69 and connected to the lowermost downstream sides of the parallel lines 55 and 63 of the first and second hydraulic pumps 50 and 51 through third and fourth check valves 85 and 86, respectively.

Since the construction, except for the first and second paths 84 and 87 connected to the third hydraulic pump 69 and connected to the input ports of the first and second control valve 59 and 76 on the lowermost downstream sides of the first and second hydraulic pumps 50 and 51 to make the hydraulic fluid from the third hydraulic pump 69 join only the hydraulic fluid of the arm cylinder 57 that is controlled by the shifting of the first and second control valves 59 and 76, is substantially the same as the construction of the hydraulic system as illustrated in FIG. 5, the detailed description thereof will be omitted. Also, the same drawing reference numerals are used for the same elements across various figures.

In the case of shifting the first control valve 59 to drive an arm, the center bypass path 52 on the first hydraulic pump side is closed. Accordingly, the hydraulic fluid of the first hydraulic pump 50 being supplied through the parallel line 55 joins the hydraulic fluid of the third hydraulic pump 69 being supplied through the discharge flow path 71, and then is supplied to the input port of the first control valve.

By the shifting of the second control valve 76, the hydraulic fluid being supplied from the second hydraulic pump 51 joins the hydraulic fluid of the output port of the first control valve 59.

Accordingly, the arm cylinder 57 is driven by the hydraulic fluid being supplied from the first, second, and third hydraulic pumps 50, 51, and 69, and thus the driving speed of the arm cylinder is increased.

Figure 8:
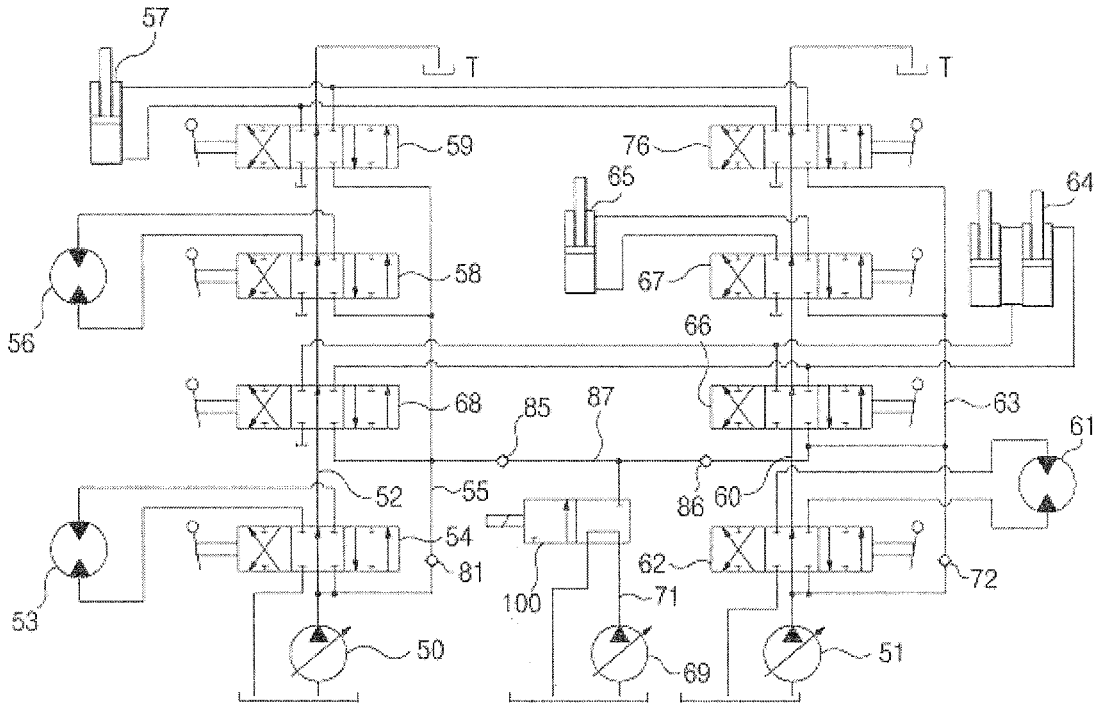
FIG. 8 is a view schematically illustrating a hydraulic system for construction equipment according to still another embodiment of the present invention.

As illustrated in FIG. 8, a hydraulic system for construction equipment according to still another embodiment of the present invention includes first, second, and third variable displacement hydraulic pumps 50, 51, and 69 connected to an engine; a first traveling control valve 54 installed in a center bypass path 52 of a first hydraulic pump 50 to control the start, stop, and direction change of a left traveling motor 53; first control valves 68, 58, and 59 installed in the center bypass path 52 on a downstream side of the first traveling control valve 54 and connected together through a parallel line 55 to control hydraulic fluid being supplied to a boom cylinder 64, a swing motor 56, and an arm cylinder 57; a second traveling control valve 62 installed in a center bypass path 60 of a second hydraulic pump 51 to control the start, stop, and direction change of a right traveling motor 61; second control valves 66, 67, and 76 installed in the center bypass path 60 on a downstream side of the second traveling control valve 62 and connected together through a parallel line 63 to control hydraulic fluid being supplied to working devices such as the boom cylinder 64, a bucket cylinder 65, and the arm cylinder 57; a second path 87 connected to a discharge flow path 71 of a third hydraulic pump 69 and connected to the parallel lines 55 and 63 of the first and second hydraulic pumps 50 and 51 on the downstream sides of the first and second traveling control valves 54 and 62 through third and fourth check valves 85 and 86, respectively; and an unload valve 100 installed in the discharge flow path 71 of the third hydraulic pump 69 and shifted, in response to an electric signal being applied when a working device is manipulated, to supply hydraulic fluid from the third hydraulic pump 69 to the parallel lines 55 and 63 of the first and second hydraulic pumps 50 and 51, respectively, the unload valve 100 returning the hydraulic fluid from the third hydraulic pump 69 to a hydraulic tank in a neutral state.

Since the construction, except for the second path 87 and the unload valve 100, is substantially the same as the construction of the hydraulic system as illustrated in FIG. 5, the detailed description thereof will be omitted. Also, the same drawing reference numerals are used for the same elements across various figures.

In the case of manipulating the working device such as a boom, the unload valve 100 is shifted in a right direction, as shown in the drawing, by the electric signal. Accordingly, the hydraulic fluid from the third hydraulic pump 69 is supplied to the parallel lines 55 and 63 of the first and second hydraulic pumps 50 and 51 through the discharge flow path 71, the unload valve 100, and the check valves 85 and 86 installed on the second path 87 in order.

By contrast, in the case where the unload valve 100 in a neutral state (i.e. the state as illustrated in FIG. 8), the hydraulic fluid from the third hydraulic pump 69 is returned to the hydraulic tank via the unload valve.

As described above, according to the hydraulic system for construction equipment according to the embodiments of the present invention, a hydraulic pump is added to the hydraulic system which has two hydraulic pumps and which is generally applied to the construction equipment so as to drive a working device, and thus the hydraulic fluid from the added hydraulic pump joins the hydraulic fluid of the actuator of the corresponding working device to increase the driving speed of the working device.

Also, when the working device and the traveling apparatus are simultaneously manipulated, the supply of the hydraulic fluid, which is supplied to the working device side, to the traveling apparatus side is intercepted, and thus the straight traveling of the construction equipment can be secured.

Although preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic system for construction equipment, comprising:

first, second, and third variable displacement hydraulic pumps connected to an engine;

a first traveling control valve installed in a center bypass path of the first hydraulic pump to control the start, stop, and direction change of a left traveling motor;

first control valves installed in the center bypass path on a downstream side of the first traveling control valve and connected together through a parallel line to control hydraulic fluid being supplied to a boom cylinder, a swing motor, and an arm cylinder;

a second traveling control valve installed in a center bypass path of the second hydraulic pump to control the start, stop, and direction change of a right traveling motor;

second control valves installed in the center bypass path on a downstream side of the second traveling control valve and connected together through a parallel line to control hydraulic fluid being supplied to the boom cylinder, a bucket cylinder, and the arm cylinder;

a first path connected to a discharge flow path of the third hydraulic pump and connected to the center bypass paths of the first and second hydraulic pumps on the downstream sides of the first and second traveling control valves through first and second check valves, respectively; and a second path connected to the discharge flow path of the third hydraulic pump and connected to the parallel lines of the first and second hydraulic pumps through third and fourth check valves, respectively.

2. The hydraulic system of claim 1, further comprising:

a backward flow prevention check valve installed on an upstream side of the parallel line of the first hydraulic pump to intercept the supply of hydraulic fluid from a working device side to a traveling apparatus side when the working device on the first hydraulic pump side and the traveling apparatus are simultaneously driven; and a backward flow prevention check valve installed on an upstream side of the parallel line of the second hydraulic pump to intercept the supply of hydraulic fluid from a working device side to a traveling apparatus side when the working device on the second hydraulic pump side and the traveling apparatus are simultaneously driven.

3. A hydraulic system for construction equipment, comprising:

first, second, and third variable displacement hydraulic pumps connected to an engine;

a first traveling control valve installed in a center bypass path of the first hydraulic pump to control the start, stop, and direction change of a left traveling motor;

first control valves installed in the center bypass path on a downstream side of the first traveling control valve and connected together through a parallel line to control hydraulic fluid being supplied to a boom cylinder, a swing motor, and an arm cylinder;

a second traveling control valve installed in a center bypass path of the second hydraulic pump to control the start, stop, and direction change of a right traveling motor;

second control valves installed in the center bypass path on a downstream side of the second traveling control valve and connected together through a parallel line to control hydraulic fluid being supplied to the boom cylinder, a bucket cylinder, and the arm cylinder;

a first path connected to a discharge flow path of the third hydraulic pump and connected to input ports of the first and second control valves on the lowermost downstream sides, among the whole first and second control valves, through first and second check valves, respectively; and a second path connected to the discharge flow path of the third hydraulic pump and connected to the lowermost downstream sides of the parallel lines of the first and second hydraulic pumps through third and fourth check valves, respectively.

4. The hydraulic system of claim 3, further comprising:

a backward flow prevention check valve installed on an upstream side of the parallel line of the first hydraulic pump to intercept the supply of hydraulic fluid from a working device side to a traveling apparatus side when the working device on the first hydraulic pump side and the traveling apparatus are simultaneously driven; and a backward flow prevention check valve installed on an upstream side of the parallel line of the second hydraulic pump to intercept the supply of hydraulic fluid from a working device side to a traveling apparatus side when the working device on the second hydraulic pump side and the traveling apparatus are simultaneously driven.

* * * * *